US007117947B2

(12) United States Patent
Wilson

(10) Patent No.: US 7,117,947 B2
(45) Date of Patent: Oct. 10, 2006

(54) WELL CHEMICAL TREATMENT UTILIZING PLUNGER LIFT DELIVERY SYSTEM

(75) Inventor: Dennis Ray Wilson, Katy, TX (US)

(73) Assignee: Conoco Phillips Company, Houston, TX (US)

( * ) Notice: Subject to any disclaimer, the term of this patent is extended or adjusted under 35 U.S.C. 154(b) by 25 days.

(21) Appl. No.: 10/630,292

(22) Filed: Jul. 30, 2003

(65) Prior Publication Data

US 2005/0022994 A1 Feb. 3, 2005

(51) Int. Cl.
*E21B 43/16* (2006.01)

(52) U.S. Cl. ..... 166/372; 166/90.1

(58) Field of Classification Search ..... 166/372, 166/68, 105, 90.1, 75.15
See application file for complete search history.

(56) References Cited

U.S. PATENT DOCUMENTS

| | | | | |
|---|---|---|---|---|
| 2,074,912 A | | 3/1937 | Hutto | 103/179 |
| 2,654,436 A | | 10/1953 | Carlisle et al. | 166/21 |
| 2,884,067 A | | 4/1959 | Marken | 166/75 |
| 3,090,316 A | | 5/1963 | Montgomery | 103/52 |
| 3,090,912 A | | 5/1963 | Ruofff | 324/54 |
| 3,412,798 A | * | 11/1968 | Gregston | 417/56 |
| 3,473,611 A | * | 10/1969 | Gregston | 166/310 |
| 3,901,313 A | | 8/1975 | Doniguian et al. | 166/64 |
| 4,347,899 A | | 9/1982 | Weeter | 166/310 |
| 4,354,553 A | | 10/1982 | Hensley | 166/244 C |
| 4,629,004 A | | 12/1986 | Griffin | 166/372 |
| 4,817,722 A | | 4/1989 | Montfort, Jr. et al. | 166/310 |
| 5,330,004 A | | 7/1994 | Williams et al. | 166/279 |
| 5,343,941 A | | 9/1994 | Raybon | 166/53 |
| 5,488,993 A | | 2/1996 | Hershberger | 166/372 |
| 5,671,813 A | | 9/1997 | Lima | 166/372 |
| 5,758,725 A | * | 6/1998 | Streetman | 166/304 |
| 6,209,637 B1 | | 4/2001 | Wells | 166/153 |
| 6,279,656 B1 | | 8/2001 | Sinclair et al. | 166/310 |
| 6,467,541 B1 | | 10/2002 | Wells | 166/153 |
| 6,648,072 B1 | * | 11/2003 | Blanchard | 166/312 |
| 2005/0150658 A1 | | 7/2005 | Farris | |

OTHER PUBLICATIONS

G. Covatch, "Consortium Selects 13 New Projects to Aid Stripper Well Operators", Stripper Well Update, GasTIPS, Spring 2003, pp. 18-24.

(Continued)

*Primary Examiner*—William P. Neuder
(74) *Attorney, Agent, or Firm*—Hitchcock Evert LLP

(57) ABSTRACT

An apparatus and method for delivery of treatment chemicals to the bottom of the wellbore. The delivery system can be a chemical dispenser which can be attached to a plunger used in plunger lift operations, a plunger which has been impregnated with treatment chemicals, a plunger/dispenser apparatus which has an interface section for interfacing with the inside of the tubing and a dispenser section. Automatic recharging or reapplication of chemicals to the chemical delivery system can be accomplished with a chemical application assembly attached to the plunger manifold.

27 Claims, 4 Drawing Sheets

OTHER PUBLICATIONS

Well Master Corporation—The Plunger Lift System, http/wellmaster.com/PlungerLift/system.html, 3 pages.

"Plunger Lift Equipment Manufacturer", Production Control Services, Inc., www.pcs.plungerlift.com, 10 pages.

S. Farris, "Plunger Conveyed Chemical System For Plunger Lift Wells", Composite Engineers, Inc., compositeengineers@bronline.com, 2 pages.

Sam Farris, U.S. Patent Application entitled "Method and Apparatus For Enhancing Oil and Gas Flow in a Well".

The University of Tulsa, The Connector (A Quarterly Newsletter from the IPEC, Spring/Summer 2004, pp. 1-8, vol. 4, No. 4, Tulsa, Oklahoma.

Gary Covatch, State-of-the-Art Technology Summary, Commercial Technologies Emerging from Stripper Well Consortium, 2004, pp. 1-5, vol. 10, 2nd Quarter, Morgantown, WV.

Gary Covatch, Consortium Selects 13 New Projects to Aid Stripper Well Operators, Spring 2003, pp. 18-24, GasTIPS.

* cited by examiner

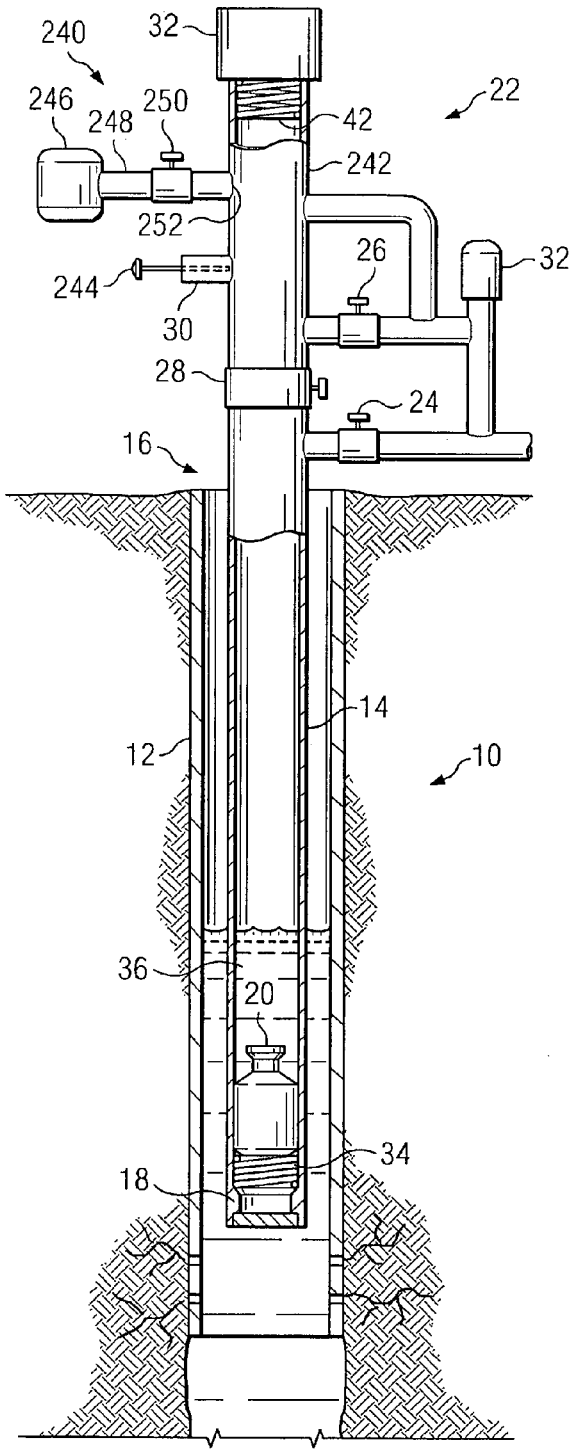
FIG. 1
FIG. 2A
(PRIOR ART)
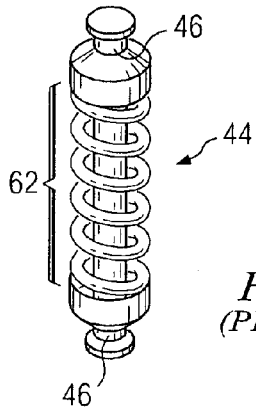
FIG. 2B
(PRIOR ART)
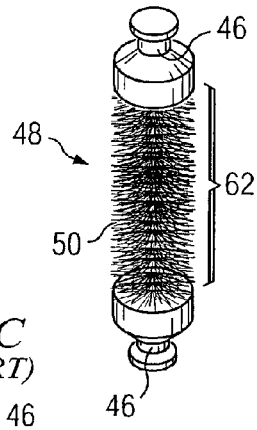
FIG. 2C
(PRIOR ART)
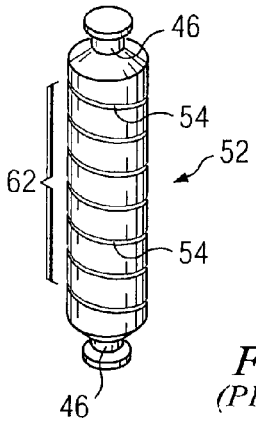
FIG. 2D
(PRIOR ART)
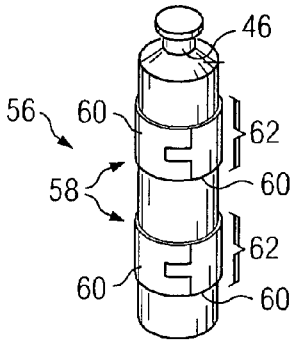

WELL CHEMICAL TREATMENT UTILIZING PLUNGER LIFT DELIVERY SYSTEM

TECHNICAL FIELD

The present invention relates to petroleum production and has significant application to gas wells which use plunger lift systems to aid in production from the well. In particular, the invention relates to delivery of treatment chemicals downhole to prevent to scale deposits, paraffin buildup, and corrosion and for other purposes.

BACKGROUND OF THE INVENTION

This invention relates to production from petroleum wells, and in particular, the delivery of chemicals downhole. The invention will find the greatest use in wells which produce gas. Thus, the background description and the description of the preferred embodiments of the invention will focus on gas wells.

Typically, as gas is produced from a well the production decreases as the pressure in the formation decreases with the quantity of gas produced from the well. Usually, a well produces not only gas but also liquids, such as water and petroleum condensates with some asphaltines. As the pressure in the formation decreases the volume and velocity of the gas flow slows. Initially, the flow rate and velocity may be sufficient to remove the liquids with the gas. At some point in time the flow rate of gas will be insufficient to carry liquids out of the well, e.g., carry water and petroleum condensates, to the surface. As a result, the liquid loading in the well will increase, and liquid will collect in the bottom of the borehole. This liquid will exert back pressure on the formation which will further decrease the production rate from the formation, and in some cases cause production to cease altogether. When production by natural reservoir pressure becomes uneconomical, artificial lift techniques can be utilized to increase well production. A number of artificial lift systems are known in the industry, including sucker rod pumps, gas lift techniques and plunger lift techniques. Also, it has been known to utilize a combination of plunger and gas lifting techniques within a well as discussed in U.S. Pat. No. 3,090,316 entitled "Gas Lifting System." Depending upon well conditions, economics and many other factors, a suitable lift technique is selected. Each technique has certain advantages and disadvantages.

Conventional plunger lift systems, which are also known as free piston systems, utilize a plunger (piston) that is dropped into the well by closing the valve on the wellhead and stopping the upward flow of gas in the well. The plunger is "free" because it is not attached to a sucker rod, cable or other mechanism to pull the plunger to the surface. The plunger falls to the bottom of the tubing and onto a bumper or stop at the bottom of the tubing. Liquid in the tubing will flow around the plunger as it falls in the tubing. After pressure in the well has built up to a predetermined load, the valve at the wellhead is opened and the gas pushes the piston upward to the surface, thereby pushing the liquid on top of the plunger to the surface. This sequence can be repeated by closing the wellhead off and allowing the plunger to fall again to the bottom of the well. Another technique is the use of a bypass plunger which is designed so as not to require the well to be shut in. U.S. Pat. No. 6,209,637 entitled "Plunger Lift with Multi Piston and Method" relates to this technique.

Frequently, a well that is utilizing plunger lift is an older well. As a result, the bottom of the well is subject to corrosion, scale, paraffin deposits, deposits of petroleum distillates and other undesirable deposits. Frequently, treatment chemicals are deposited downhole. These treatment chemicals can include such things as soap, acid, corrosion inhibitors, solvents for paraffin and petroleum distillates, stabilizers and other known treatment chemicals. A number of techniques have been employed to deliver treatment chemicals downhole. These techniques have many drawbacks, especially when they are employed with plunger lift production methods.

One method of treatment is to continuously pump a small amount of treatment chemical into the well during production. The treatment chemical falls to the bottom of the well, where it mixes with other fluids and is drawn up with the liquid lifted by the plunger. This continuous treatment approach usually requires a conduit to deliver the chemical to the bottom of the well and uses an unnecessarily large amount of chemicals. Another method is to use a batch treatment that involves pumping liquid treatment chemicals down the borehole relying on a dead space below the perforations to retain residual chemical for a period of time. The method is not reliable, and is unsuitable for use in some wells due to lack of perforations to retain the residual chemical, or because well production rates are so high as to quickly remove the chemicals. Thus, there has been a need for a method and apparatus to provide treatment chemicals down a wellbore which is efficient in the delivery of chemicals, minimizes waste of treatment chemicals, and minimizes disruption to production from the well. The current invention has the advantages of repeatedly delivering chemicals to the bottom of the oil or gas well to prevent scale deposits and/or corrosion. The current invention has the advantages of being economical, requiring little in the way of additional equipment and allowing continuous treatment of the wellbore. Thus, the system is much more efficient than existing delivery methods, in that it can concentrate chemical where it is often most needed which is at and below the stop (seating nipple), and is much less expensive to install than the continuous chemical injection method.

BRIEF DESCRIPTION OF THE DRAWINGS

The invention will be better understood with reference to the drawings taken in connection with the detailed description which follows:

FIG. 1 is a cross-sectional area of a wellbore showing a well head manifold of the present invention;

FIGS. 2A, 2B, 2C and 2D are prospective illustrations of four prior art plungers;

The drawings illustrate certain preferred embodiments of the invention and like elements have been provided with like reference numerals to corresponding items between various drawings.

SUMMARY OF THE INVENTION

Figure 3:
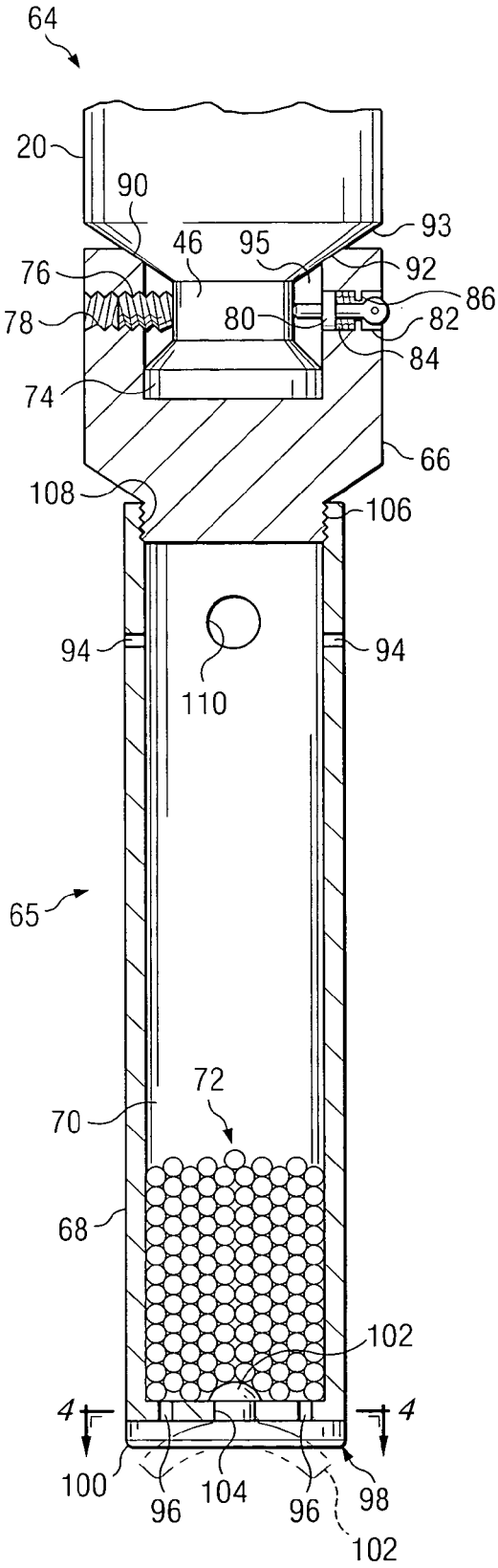
FIG. 3 is a cross-sectional view of one embodiment of a chemical dispenser of the present invention.

The present invention relates to a method and apparatus for delivery of treatment chemicals to a wellbore utilizing artificial lift techniques. In the method of the present invention, one or more treatment chemicals for treating a downhole formation are delivered to the bottom of the wellbore in association with the placement of a plunger at the bottom of the wellbore. In one embodiment, the invention relates to a method of applying the treatment chemical to a known plunger, such as a coiled tube plunger, or a brush plunger in the form of a gel, putty, paste or other suitable consistency such that a significant portion of the treatment chemical will be retained on the plunger as it is dropped from the well head to the bottom of the wellbore. Once at the bottom of the wellbore, the fluid in the wellbore dissolves or mixes with the treatment chemical which dissociates or diffuses into the wellbore, treating the wellbore and the near wellbore area. At predetermined times when the plunger returns to the surface additional treatment chemical can be applied to the plunger before it is again dropped to the bottom of the wellbore. Alternatively, the method can be conducted by placing the treatment chemical within a chemical dispenser attached to a standard plunger, or in a specifically designed plunger/dispenser device which is a combination of a plunger and dispensing unit.

In another aspect, the present invention relates to a plunger/dispenser apparatus. The apparatus includes an interface area and a dispenser section which includes one or more receptacles for receipt of treatment chemical. The plunger/dispenser may also have a neck for engagement with a plunger catcher, and/or downhole tools.

In yet another aspect, the present invention relates to a chemical dispenser which can be attached to a known plunger. The dispenser includes a head with an attachment mechanism for attaching to a known plunger, and one or more receptacles for receipt of treatment chemicals. In one embodiment of the invention, the receptacle may be an elongate chamber having lower ports and upper ports. In a preferred embodiment, a valve is associated with the lower ports to control flow of liquid through the lower ports.

In one embodiment, the valve may be a flexible polymeric sheet which is pressed against the lower ports as the dispenser falls through the wellbore and liquid. When the dispenser comes to rest at the bottom of the wellbore, the flexible sheet will fall away from the lower ports of the dispenser, opening the lower ports to liquid flow so that the chemical within the dispenser can be dissolved into the liquid.

Also, in a preferred embodiment of the invention, the dispenser may include an extension or standoff section which allows the receptacle holding the treatment chemical to be positioned below the lower end of the tubing when the plunger assembly comes to rest at the bottom of the well. This allows the treatment chemical to be dissolved into or mixed with the liquid located in the near wellbore area, thereby increasing the efficiency of the chemical delivery.

In another aspect, the invention relates to a chemical application apparatus. The apparatus is a modification to manifold systems used in plunger lift operations. In this embodiment an applicator is positioned in the section of the manifold which receives the delivery system, e.g., plunger, or plunger/dispenser apparatus, or plunger with attached chemical dispenser. The applicator is positioned such that it will be operatively adjacent to the receptacle portion of the plunger, plunger/dispenser or chemical dispenser attached to a plunger. The nature of the applicator can vary depending upon the form in which the chemical is utilized.

The invention also includes a method for the recharging of chemical to the chemical delivery system. This method involves catching the chemical delivery system in a manifold and applying chemical to the assembly without removing the assembly from the manifold.

The automated application of chemicals to the delivery system is especially suited to the application of gels and paste. In these applications the applicator can include a nozzle which communicates with an opening in the manifold and is aligned such that it delivers chemical at the desired portion of the chemical delivery system. The nozzle can be connected to a storage tank for the chemical via a conduit. A control valve to control the flow of chemical from the storage container to the nozzle can be provided in the conduit between the storage container and the nozzle, or at other suitable locations.

The chemical in the delivery system can also be recharged by removing the delivery system from the manifold and recharging the chemical. This method can be used for any form in which the chemical is used, such as, stick, time release capsules, gel, paste, putty, liquid, emulsion, etc.

DETAILED DESCRIPTION

For purposes of background, an abbreviated discussion of the plunger lift technique will be presented. Those skilled in the art will recognize that there are many variations which have been used in connection with the lift technique and system which is described. The preferred embodiment of the invention specifically described can be modified for variations of the described lift system. Further, those skilled in the art will appreciate that the present invention need not be used to the exclusion of other chemical treatment methods. Costs and other considerations can result in the use of the present invention together with other treatment methods.

With reference to FIG. 1, the petroleum well will have a wellbore 10 which typically contains a casing 12 either throughout the entire bore or a portion of the wellbore. The wellbore 10 can also contain tubing 14 within the casing 12. In a typical arrangement, the well production will flow through the tubing 14 to the wellhead 16. For purposes of illustrating the invention, the invention is discussed in relation to a gas well. For gas lift operations the tubing 14 can be provided with a stop 18 at the lower end of the tubing 14, and a plunger 20 which travels in the tubing 14, and to the wellhead 16. In a typical arrangement, a manifold 22 is provided at the wellhead 16 which can have a plunger catch 30 to hold the plunger in place, a lubricator 32 to lubricate the plunger 20, and a control box (not shown) to control the flow of gas and liquid from the well by operating the valves 24, 26, and 28 and related conduits.

The stop 18 is to prevent the plunger 20 from falling below the position of the stop 18. The stop 18 can include a spring 34 or other shock absorbing device to reduce the impact of the falling plunger 20. The plunger 20 can be of any of the numerous designs which are known in the art or another delivery system as described herein. The plunger 20 provides a mechanical interface between the gas (not shown) and the liquid 36 present in the well. Shutting the well off at the surface allows the plunger 20 to fall to the bottom of the well and rest on the stop 18. The pressure differential between gas trapped in the wellbore between the casing 12 and tubing 14 and in the tubing 14 above the plunger increases. The fluid will pass around the plunger 20 through a space left between the plunger 20 and the tubing 14 or through passageways in the plunger. Gas pressure builds in the well, and when the well is opened, the gas will push the plunger 20 and the liquid on top of the plunger up the tubing 14 to the surface.

When the plunger 20 reaches the top of the well it enters or is received by the manifold 22. The manifold 22 can include a shock absorbing spring 42 or other mechanism to reduce the impact of the plunger. Appropriate sensors are provided to detect arrival of the plunger 20 at the surface and to activate plunger catch 30 which holds the plunger 20 until a signal is received to release the plunger 20. The control box (not shown) contains circuitry for opening and closing the appropriate valves 24, 26, and 28 during the different phases of the lift process, applying lubrication, if desired, to the plunger from lubricator 32 and releasing the plunger 20 to return to the bottom of the tubing 14.

Various plunger designs and plunger lift control systems are well known in the art. For example, U.S. Pat. No. 6,209,637 entitled "Plunger Lift with Multi-Part Piston and Method of Using the Same" discloses a multi-part plunger. This multi-part plunger is designed to allow the piston to drop into the well while the well is still flowing. After the plunger drops a ball is dropped on top of the plunger which seals a passageway through the plunger. This allows the two-part plunger then to function as a one-piece plunger. The present invention is suitable for use with any known plunger lift system.

FIGS. 2A, 2B, 2C, and 2D illustrate several prior art plungers. These figures show several types of prior art plungers, and are not intended to be all inclusive. FIG. 2A illustrates a coiled tubing plunger 44. Each end of the coiled tubing plunger 44 is provided with a neck 46. Necks 46 are provided in most plungers to provide an area where the plunger can be caught by the plunger catcher, and also to provide an area which may be engaged by a downhole tool in the event the plunger becomes stuck in the tubing. FIG. 2B illustrates a brush plunger 48. Brush plunger 48 is also provided with necks 46 at each end. The brush 50 may be a flexible nylon brush, a metal fiber brush or a brush made from any other suitable material. FIG. 2C illustrates a solid bar stock plunger 52. The bar stock plunger 52 has necks 46 at each end, and has a plurality of ridges or a helical groove 54 along its length. FIG. 2D illustrates a pad plunger 56 which has pads 58 which are made up of pad plates 60. The pad plates 60 can be spring loaded so that they expand or contract to maintain contact with the inside of the tubing. The illustrated pad plunger 56 is a two-pad plunger but pad plungers can have one or more pads. The illustrated pad plunger 56 has a neck 46 at the top. However, a neck can also be provided at the opposite end. Each plunger has one or more interface sections 62 which are the portions of the plunger designed to interface with the inside of the tubing.

Other types of plungers include a wobble washer plunger (not shown) which has a series of shifting rings placed along the length of the plunger to maintain contact with the inside of the tubing; and a snake plunger (not shown).

Referring now to FIG. 3, there is shown a delivery system 64 for chemicals. Only a portion of the plunger 20 is shown. The system 64 is a plunger 20 with an attached chemical dispenser 65. The plunger 20 can be of any known design which has a neck 46 on the lower end. In this embodiment, chemical dispenser 65 has a head portion 66 and a member 68 which defines a receptacle 70 for receiving treatment chemical 72. Head 66 defines an opening 95 to receive the lower portion of plunger 20 and the plunger neck 46. Head 66 includes attachment mechanism for attaching the dispenser 65 to the plunger. One attachment mechanism can be a set screw 76 in threaded passageway 78 in head 66. Another attachment mechanism can be a spring loaded bolt 80 in passageway 82. A spring 84 biases the bolt 80 against the neck 46 of the plunger 20. A ridge 86 can be provided in the passageway 82 against which the spring 84 rests. To remove the head 66 the bolt 80 and screw 76 are retracted. For purposes of illustration two different attachment mechanisms are shown in FIG. 3. Typically one or more of the same attachment mechanisms will be utilized, for example, one or more set screws 76 or one or more bolts 80, rather than having a mixture of different types of attachment mechanisms.

The chemical dispenser 65 should securely attach to plunger 20. In some applications it may be desirable for the chemical dispenser 65 to have some play in the connection between the plunger 20 and the chemical dispenser 65 to permit a slight wobble. Some operators may prefer a more rigid fit, in which case, a portion of the upper surface 90 of head 66 can be a shaped surface which mates with a corresponding surface 92 on the plunger 20 so as to limit the movement of the plunger with respect to the dispenser. In a preferred embodiment, one or more upper ports 94 are provided, and one or more lower ports 96 are provided. Upper ports 94 allow gas and liquid to enter or leave the receptacle 70. While the plunger is falling in the tubing the primary function of ports 94 is to exhaust any gas and liquid which may enter the receptacle to aid the fall of the plunger. Once the plunger has reached the stop at the bottom of the tubing the upper ports 94, if below the liquid level, will function to allow chemical contained in the receptacle to diffuse into or mix with the liquid. Lower ports 96 allow liquid to enter and leave the receptacle 70. In the illustrated embodiment, the lower ports 96 are on the bottom surface of the member 68; however, they can also be positioned on the side walls. Preferably, a valve 98 is provided. In the illustrated embodiment, valve 98 is a flexible rubber sheet 100 having a dimension sufficient to cover lower ports 96. Valve 98 is held in place by a retaining plug 102 which can extend through an opening 104 in the bottom of the member 68. The purpose of valve 98 is to either restrict or close off the flow of liquid through lower ports 96 as the plunger drops. As the plunger drops in the tubing, the flexible sheet 100 will be pushed against the bottom of the member 68. This will either completely seal or partially seal off ports 96. The purpose of valve 98 is to minimize or prevent the flow of fluid through receptacle 70 while the system drops in the tubing. This will prevent or minimize the washing of chemicals out of the receptacle as the chemical dispenser 65 passes through the fluid above the stop of the tubing. Once the delivery system 64 comes to rest on the stop, flexible sheet 100 will fall away from the bottom of member 68 and to a second position 102 (shown in phantom), because there is no force pushing the flexible sheet 100 against the bottom of member 68. This will allow liquid to enter receptacle 70 and leach the treatment chemical 72 out of receptacle 70.

FIG. 3 illustrates the preferred embodiment providing a threaded surface 106 on the bottom of head 66 to engage a threaded surface 108 on member 68. This allows member 68 to be removed from head 66 for the insertion of chemicals into the receptacle 70. Alternatively, head 66 and member 68 can be one piece, and an opening 110 provided through which chemicals can be inserted into the receptacle 76.

Figure 4:
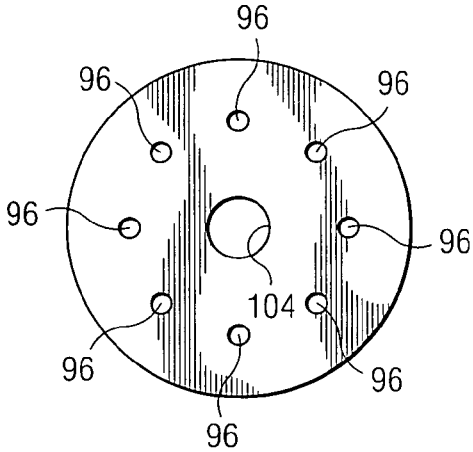
FIG. 4 is a cross-sectional view along line 4—4 of FIG. 3.

FIG. 4 is a cross sectional view of FIG. 3 across line 4—4. It illustrates a plurality of lower ports 96. Through a center opening 104 passes a portion of the valve in the form of flexible sheet 100.

Figure 5:
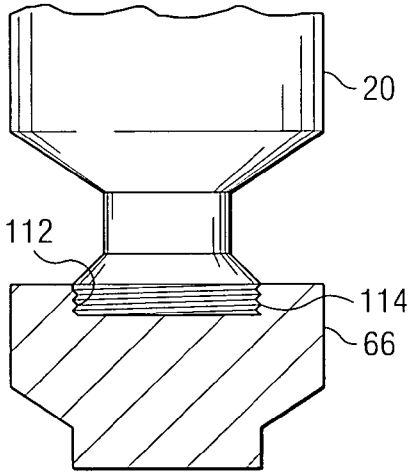
FIG. 5 is a partial cross-sectional view showing one embodiment of an attachment mechanism of the present invention.

FIG. 5 shows another attachment mechanism for attaching the plunger 20 to head 66. In this embodiment, the lower portion of the plunger has a male threaded surface 112 and head 66 is provided with a corresponding female threaded surface 114. This allows the head 66 to be attached to plunger 20. Many other connection mechanisms can be used other than those illustrated herein.

Figure 6:
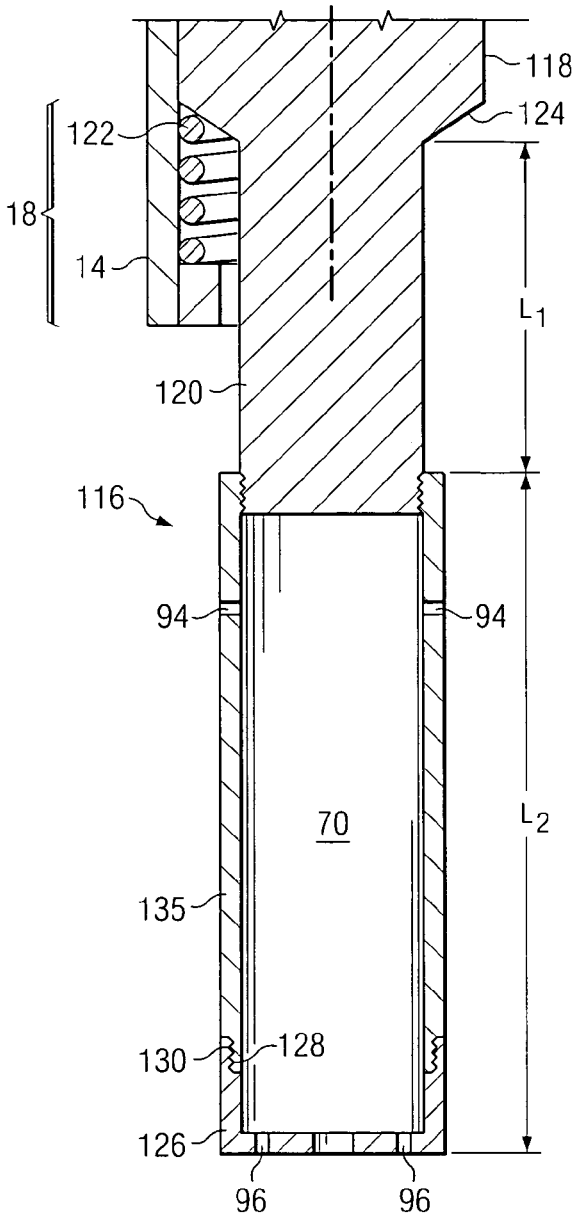
FIG. 6 is a partial cross-sectional view of another embodiment of the present invention.

FIG. 6 is a partial view of a chemical dispenser 116. In this embodiment, a cap 126 having a threaded surface 128 for engaging threaded surface 130 of the wall 135 defining the receptacle 70 is provided. As shown in FIG. 3. the cap 126 contains lower ports 96, while the wall defining the receptacle defines upper ports 94. In this embodiment, between head 118 and chemical dispenser 116 is standoff section 120. Standoff section 120 has the length $L_1$ and receptacle section 70 has a length $L_2$. For purposes of illustration, only one side of tubing 14 is shown together with stop 18. In this illustration stop 18 includes a shock absorbing spring 122 which absorbs the impact of the delivery system. Head 118 is provided with a surface 124 which contacts the spring of the stop 18. Standoff section 120 has a sufficient length to allow the receptacle 70 to be positioned below the lower end of tubing 14. This is advantageous because it allows the chemicals in the receptacle to diffuse in the wellbore below the tubing, rather than diffusing inside the tubing. Generally, the treatment of the formation will be more effective when the chemical diffuses directly into the space below the tubing. Preferably, the chemical dispenser 116 is dimension such that at least a portion of it will pass through the stop. An advantage of the present invention is that the assembly can be constructed to place the dispenser at a predetermined location in relation to the stop. Pressure drop occurs across the stop during operation, and this pressure drop can produce temperature and pressure changes which cause scale deposits to form in the stop. If scale deposits are allowed to buildup on the stop, the deposits can become great enough to cause the plunger to become stuck in the stop. If this occurs, it may be necessary to use wireline removal techniques, or a rig to pull the tubing. With the present invention, treatment chemicals are delivered and concentrated in the vicinity of the stop, and thus scale formation can be very effectively treated. Indeed, the dispenser can be configured to come to rest within the stop for treatment of scale, and later reconfigured to add in the standoff section to provide treatment below the stop.

Figure 7:
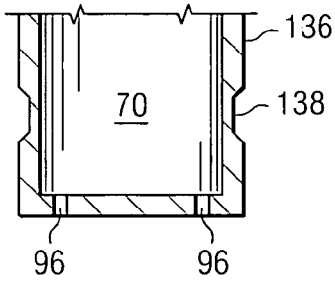
FIG. 7 is a cross-sectional view of yet another embodiment of the present invention.

FIG. 7 is another embodiment of the present invention. FIG. 7 shows the lower half of the wall 136 of a chemical dispenser of the invention having an area of reduced outer diameter to provide neck 138. This provides an area which can be engaged by the plunger catcher on the surface.

Figure 8:
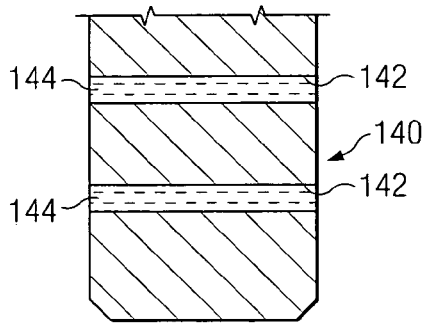
FIG. 8 is a partial cross-sectional view of another embodiment of the present invention.

FIG. 8 shows another embodiment of the present invention. In FIG. 8 the lower portion of the chemical dispenser 140 has receptacles for treatment chemical in the form of one or more passageways 142. Chemical sticks 144 can be inserted into the receptacles, or the passageways 144 can be packed with chemical in a paste form or other form.

Figure 9:
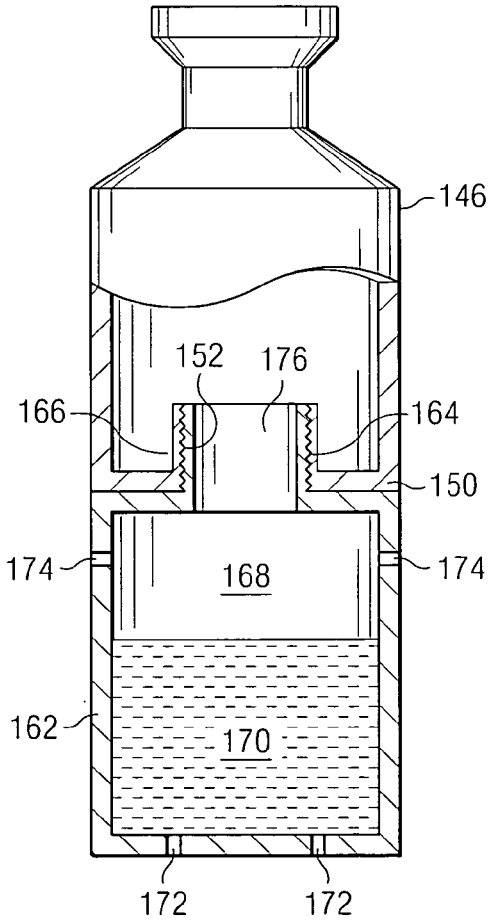
FIG. 9 is a cross-sectional view of an embodiment of the present invention.

FIG. 9 shows another embodiment of the present invention. In FIG. 9 the plunger 146 does not have a neck at the lower end, but rather has an annular end 150 which has an inside threaded surface 152. The chemical dispenser 162 is a tubular member having a reduced diameter portion 164 at the top which has threads on its outside surface 166 for engaging the threaded surface 152 of plunger 146. Dispenser 162 defines a receptacle 168 for holding chemical 170. The plunger has lower ports 172 and one or more upper ports 174. To load the dispenser 162 with chemicals, the dispenser 162 is removed from the plunger 146 and the chemicals are inserted through the opening 176 at the top. If desired, such an assembly can also be equipped with a valve (not shown) to restrict flow into the lower ports 172.

Figure 10:
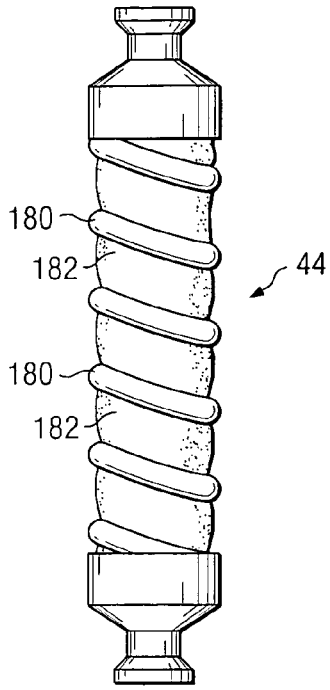
FIG. 10 is a cross-sectional side view of another embodiment of the invention utilizing a coiled tube plunger with applied treatment chemical solution.
Figure 11:
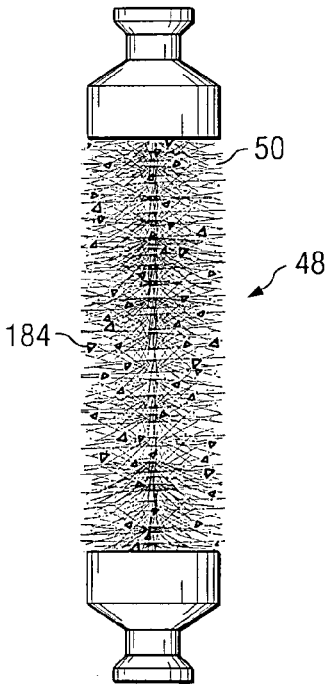
FIG. 11 is a side view of a brush plunger with applied treatment chemical.

FIGS. 10 and 11 illustrate yet other embodiments of the present invention. These embodiments use known plungers as carriers for the chemicals. FIG. 10 illustrates a coiled tube plunger 44. In this embodiment of the invention, the space between coiled member 180 of plunger 44 is partially or completely filled with chemical 182. Chemical 182 may be in the form of a paste or treatment chemical formed into an appropriate consistency for packing into the space between the coils. In FIG. 11, a wire brush plunger 48 is shown. In this embodiment of the invention, the brush portion 50 of the plunger 48 is impregnated with treatment chemical 84. The treatment chemical can be applied in the form of a spray, paste, or gel. Preferably, it has the consistency which will be retained on the brush as it falls through the tubing. The embodiments of FIGS. 10 and 11 have the advantage of utilizing existing plungers as the delivery system. They have the disadvantage, however, that when the plunger comes to rest on the stop the treatment chemical will be positioned in the tubing. Thus, the chemical must be dissolved within the tubing and then migrate to the formation to provide treatment. This embodiment has an advantage in the treatment and prevention of paraffin deposits. Paraffin problems usually occur above the stop. Generally, paraffin problems occur above the 2000 feet level, and most commonly occur from about 1500 to 1600 feet from the surface. In the past, plungers aided in the removal of paraffin deposits because as the plunger passed the deposit it would tend to scrape off some of the paraffin. This embodiment allows for the delivery of chemical along the tubing to prevent or minimize paraffin deposit and build up.

Figure 12:
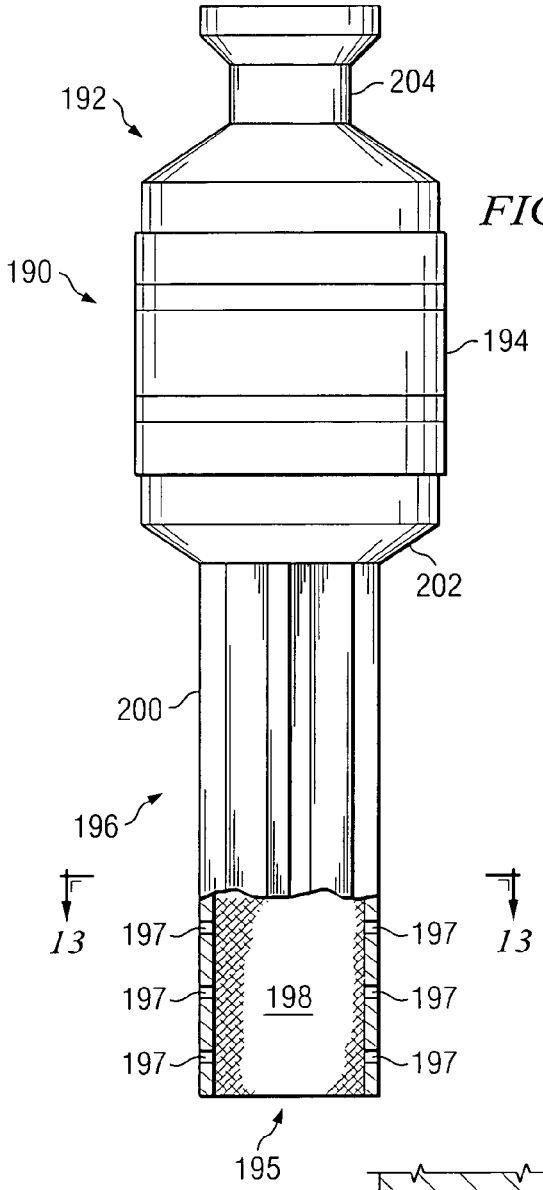
FIG. 12 is a side view of a plunger/dispenser of the present invention.
Figure 13:
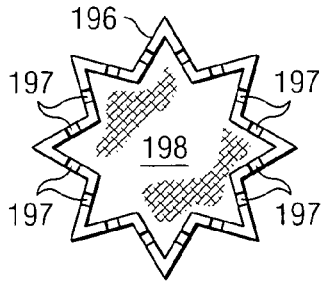
FIG. 13 is a cross-sectional view of FIG. 12 along line 13—13.

FIG. 12 illustrates plunger/dispenser 190. Previous embodiments discussed related to a chemical dispenser to be attached to a known plunger and a modification of the known plunger by the application of treatment chemicals known to be useful in the present invention. FIG. 12 relates to an embodiment of the present invention in which the device is specifically configured to be both a plunger and a chemical delivery system. The assembly has an upper portion 192 which includes an interface section 194. The interface section is that portion which is adjacent to the inside wall of the tubing. The interface section may be coiled tubing, a brush, pads, wobble rings or other known interface sections. The interface section fits inside the tubing snugly. When the pressure is released from the well and the plunger travels to the surface, the interface section serves to retain much of the fluid above the top of the plunger above the plunger so that it may be pushed out at the well head. Below the interface section is the lower section 196. The lower section 196 can include any type of receptacle to receive chemicals, such as an absorbent pad or matrix, or other suitable structure as described above. In the illustrated embodiment, the receptacle is a stiff wire mesh 198, and chemical has been deposited in the interstices between the mesh. A lower port not shown can be provided at the bottom, and a series of ports not shown can be provided along the length of lower section 196. Thus lower section 196 defines a receptacle having one or more upper ports and one or more lower ports. This embodiment also has a standoff section 200 for elongating the system such that all or a portion of the receptacle will be below the end of the stop on the tubing. The lower end of the upper section 192 is of reduced diameter to provide surface 202 for contacting the stops. A neck 204 is provided on the top. FIG. 13 is a cross section of FIG. 12 along line 13—13. The cross section is of a multipoint star design. This design increases the surface area of the dispenser exposed to the well liquid and provides flow paths for the liquid. In the preferred embodiment the chemical receptacle portion 198 of the apparatus 190 is of small enough dimensions to pass through the stop at the bottom of the tubing.

Figure 14:
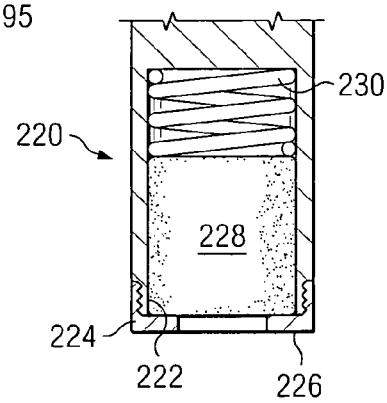
FIG. 14 is a partial cross-sectional view of an embodiment of the chemical dispenser of the present invention.

In addition to previously described embodiments of receptacles, an additional embodiment is illustrated in FIG. 14. In the illustrated embodiment the dispenser section 220 is tubular and defines an opening 222. The opening is partially closed by a removable cap 224. The cap is annular to provide a retaining ring 226 which extends inwardly to provide a rest to retain a chemical stick 228 within the dispenser. The stick of treatment chemical is inserted into the tubular section and bias spring 230 can be provided to force the stick against the annular cap. Thus, the lower portion of the stick can be exposed to liquid at the bottom of the well and as the end dissolves the spring pushes the remainder of the stick outwardly.

Referring to FIG. 1 the present invention also includes a chemical application assembly 240. A section of conduit 242 of the manifold 22 below the lubricator 32 receives the plunger which is caught by plunger catcher 30. Plunger catcher 30 has a movable pin 244 which can engage a neck on the plunger or the delivery system. When it is desired to release the plunger the pin 244 is retracted to allow the plunger to fall. Designs and construction of plunger catchers are well known in the art.

Chemical application assembly 240 includes a chemical storage reservoir 246 which is connected by conduit 248 to a valve 250 which is connected to applicator 252. Applicator 252 can be a nozzle, an open end of conduit, or other device. The selection of the specific applicator will be made taking into account the physical characteristics of the form of the treatment chemical. In a preferred embodiment, the treatment chemical for use with the chemical application assembly will be a viscous liquid or gel. Once the receptacle section of dispenser is aligned with the applicator, the valve 252 can be opened and chemical forced onto the plunger or into the chemical dispenser to recharge the treatment chemical. Any suitable mode of force can be utilized to force the chemical from storage container 246 including pressurizing the storage container 246 or by pumping. The use of the chemical application apparatus 240 is not required. Alternatively, the plunger and/or the plunger and chemical carrier can be removed from manifold 16, inspected and the chemical agent recharged if needed.

The chemical carrier can be made out of any material which is suitable for use in the construction of plungers. While necks have been illustrated, any other design known in the art which allows engagement with a recovery tool or with the plunger catcher is acceptable.

The treatment chemical can be any known treatment chemical. Further, the treatment chemical can be encapsulated in time-release capsules or in water-soluble gels. Treatment chemicals which can be used include paraffin solvents, clay stabilizers, paraffin inhibitors, kelating agents, scale inhibitors, solvents, corrosion inhibitors, acid, and soap. Suitable encapsulated treatment chemicals are described in U.S. Pat. No. 6,279,656 B1 entitled "Downhole Chemical Delivery System for Oil and Gas Wells."

Although the invention has been disclosed and described in relation to its preferred embodiments with a certain degree of particularity, it is understood that the present disclosure of some preferred forms is only by way of example and that numerous changes in the details of construction and operation and in the combination and arrangements of parts may be resorted to without departing from the spirit of the scope of the invention as claimed here.

The invention claimed is:

1. A delivery apparatus for delivery of chemicals down a wellbore which includes a defined stop position at the bottom of a tubing string located inside said wellbore comprising:

an elongate member;

an interface section on the upper portion of said elongate member; and a chemical dispensing section in the lower portion of said elongate member, wherein said chemical dispensing section is dimension so to be able to pass through said stop at the bottom of said tubing string.

2. A delivery apparatus of claim 1 wherein said chemical dispensing section defines one or more receptacles for receiving treatment chemical.

3. A delivery apparatus of claim 2 further comprising a treatment chemical is in the form of a stick or time release capsules in said dispensing section.

4. A delivery apparatus of claim 1 further comprising a treatment chemical is in the form of a stick or time release capsules in said dispensing section.

5. An apparatus for the charging of treatment chemical to a chemical delivery system comprising:

a conduit in a wellhead manifold which receives a chemical system said conduit having an opening along its length;

a plunger catcher connected to said conduit;

an applicator connected to said opening said applicator having an open end positioned to apply treatment chemical to the outer surface of a plunger; and a delivery conduit connected to said applicator.

6. An apparatus of claim 5 further comprising a chemical storage source connected to said delivery conduit.

7. An apparatus of claim 5 further comprising a valve connected to said delivery conduit.

8. A chemical dispenser for use with a plunger in a wellbore comprising:

a head member; and a body defining at least one receptacle for a treatment chemical said body also defining one or more upper ports and one or more lower ports; wherein said at least one receptacle is a wire mesh defining interstices.

9. A chemical dispenser for use with a plunger in a wellbore comprising:

a body defining at least one receptacle for a treatment chemical;

an attachment mechanism connected to said body; and wherein said at least one receptacle is a wire mesh defining interstices.

10. A chemical delivery system for delivering chemicals down a wellbore comprising:

a plunger; and a chemical dispenser attached to said plunger said chemical dispenser having one or more receptacles for receiving treatment chemicals, wherein said chemical dispenser includes a stand off section, said stand off section and the portion of said dispenser having said one or more receptacles for receiving treatment chemicals are dimensioned such that they can pass through a stop at the bottom of a tubing string.

11. A chemical delivery system of claim 10 further comprising a treatment chemical is in the form of a stick or time release capsules in said one or more receptacles.

12. A chemical dispenser for use with a plunger in a wellbore which includes a defined stop positioned at the bottom of a tubing string located inside said wellbore comprising:

a body defining a receptacle for receiving a treatment chemical; and said body portion defining said receptacle being dimensioned such that it can pass through said defined stop at the bottom of said tubing string.

13. A chemical dispenser of claim 12 wherein said body also defines one or more upper ports and one or more lower ports for flow into and out of said receptacle.

14. A chemical dispenser of claim 13 further comprising a valve to control liquid flow into said one or more lower ports.

15. A chemical dispenser of claim 14 wherein said valve is a flexible sheet.

16. A chemical delivery system of claim 13 further comprising a treatment chemical is in the form of a stick or time release capsules in said one or more receptacles.

17. A chemical delivery system of claim 14 further comprising a treatment chemical is in the form of a stick or time release capsules in said one or more receptacles.

18. A chemical delivery system of claim 15 further comprising a treatment chemical is in the form of a stick or time release capsules in said one or more receptacles.

19. A chemical dispenser of claim 12 wherein said at least one receptacle is a wire mesh defining interstices.

20. A chemical delivery system of claim 12 further comprising a treatment chemical is in the form of a stick or time release capsules in said one or more receptacles.

21. A plunger apparatus for treating the downhole sections of a wellbore with said plunger during plunger lift production procedures in a well characterized by a treatment chemical deposited on the outside of said plunger, wherein said plunger is selected from the group consisting of a coiled tube plunger, a brush plunger, and a bar plunger having one or more exterior grooves.

22. A delivery apparatus for delivery of chemicals down a wellbore comprising:

a plunger having an outer diameter and defining portions having a smaller diameter which are open to the exterior thereby defining a space open to the exterior of said plunger along the side of said plunger; and a treatment chemical applied to said space and at least partially filling said space.

23. A plunger apparatus of claim 22 wherein said plunger is selected from the group consisting of a coiled tube plunger, a brush plunger, a bar plunger having one or more exterior grooves, wobble washer plunger, and a snake plunger.

24. A chemical delivery apparatus comprising:

an elongate member;

an interface section on the upper portion of said elongate member;

a chemical dispensing section in the lower portion of said elongate member;

a standoff section between said interface section and said chemical dispensing section;

wherein said chemical dispensing section is dimensioned so as to be able to pass through a stop at the bottom of a tubing string; and wherein at least a portion of said standoff section is dimensioned so as to be able to pass through a stop at the bottom of a tubing string.

25. A chemical delivery apparatus of claim 24 wherein the length of said standoff section is sufficient such that all or a portion of said chemical dispensing section extends below the bottom of the stop on the end of the tubing.

26. A chemical delivery apparatus of claim 24 wherein the length of said standoff section is sufficient such that all or a portion of said chemical dispensing section extends below the bottom of the tubing.

27. A chemical delivery system of claim 24 further comprising a treatment chemical is in the form of a stick or time release capsules in said chemical dispensing section.

* * * * *

UNITED STATES PATENT AND TRADEMARK OFFICE

CERTIFICATE OF CORRECTION

PATENT NO. : 7,117,947 B2
APPLICATION NO. : 10/630292
DATED : October 10, 2006
INVENTOR(S) : Dennis Ray Wilson It is certified that error appears in the above-identified patent and that said Letters Patent is hereby corrected as shown below:

Title page, item (73) please delete “Conoco Phillips Company” and insert --ConocoPhillips Company--
Column 10, line 19 please delete “position” and insert --positioned--
Column 10, line 27 after “said” please insert -- defined--

Signed and Sealed this

Seventeenth Day of April, 2007

JON W. DUDAS
*Director of the United States Patent and Trademark Office*